US005798477A

United States Patent [19]

Givens et al.

[11] Patent Number: 5,798,477

[45] Date of Patent: Aug. 25, 1998

[54] EXPLOSIVE CARTRIDGE ASSEMBLY FOR PRESPLITTING ROCK

[76] Inventors: Richard W. Givens, 980 Norway Dr., Columbus, Ohio 43221; Greg S. Williams, 4434 Raccoon Valley Rd., Alexandria, Ohio 43001

[21] Appl. No.: 769,598

[22] Filed: Dec. 18, 1996

[51] Int. Cl.[6] ..... F42B 3/00; F42D 3/00

[52] U.S. Cl. ..... 102/319; 102/312; 102/313; 102/323; 102/324; 102/331; 102/332; 102/302

[58] Field of Search ..... 102/313, 319, 102/323, 324, 331, 332, 302

[56] References Cited

U.S. PATENT DOCUMENTS

| | | | |
|---|---|---|---|
| 3,604,353 | 9/1971 | Newman | 102/332 |
| 3,604,354 | 9/1971 | Brown et al. | 102/24 R |
| 4,334,476 | 6/1982 | Day et al. | 102/275.7 |
| 4,961,381 | 10/1990 | McLaughlin | 102/319 |
| 4,987,818 | 1/1991 | Alford | 86/1.1 |
| 5,259,316 | 11/1993 | Nelson et al. | 102/312 |
| 5,435,250 | 7/1995 | Pollock | 102/317 |

*Primary Examiner*—Peter A. Nelson
*Attorney, Agent, or Firm*—Porter, Wright, Morris & Arthur

[57] ABSTRACT

The present invention includes a small diameter explosive cartridge and a two-stage large diameter explosive cartridge apparatus for presplitting rock can be axially detonated by detonating cord through a central detonation passageway in the explosive cartridge while keeping the detonating cord and the explosive material in the explosive cartridge physically separate. The explosive cartridge includes an outer tube and an inner tube inside of the outer tube. The explosive cartridge includes two or more continuous webs extending radially between the outer surface of the inner tube and the inner surface of the outer tube. For the small diameter explosive cartridge, the space between the outer surface of the inner tube and the inner surface of the outer tube is filled with high explosive material such as water gel or emulsion explosive material. The inside of the inner tube forms a central detonation passageway axially through the small diameter explosive cartridge through which detonating cord can be strung to provide axial detonation and to provide effective detonation between each of the small diameter explosive cartridges when the small diameter explosive cartridges are assembled on a line of detonating cord in a borehole, while keeping the detonating cord and the emulsion explosive material in the small diameter explosive cartridge physically separate. The two-stage large diameter explosive cartridge apparatus includes a large diameter explosive cartridge and a small diameter explosive cartridge.

34 Claims, 6 Drawing Sheets

EXPLOSIVE CARTRIDGE ASSEMBLY FOR PRESPLITTING ROCK

FIELD OF THE INVENTION

The present invention generally relates to an explosive cartridge assembly for presplitting rock that can be axially detonated by detonating cord through a central detonation passageway through the explosive cartridge while keeping the detonating cord and the explosive material physically separate.

BACKGROUND AND SUMMARY OF THE INVENTION

In blasting, packaged or bulk explosives are loaded into boreholes drilled to a desired depth in some geometrical pattern, typically square or rectangular. A number of boreholes are then initiated in a designed sequence to fragment the rock mass into loadable size units. Borehole diameters are typically in the 3 to 15 inch range.

Unlike in production blasting of rock, in presplitting of rock, no crushing or displacement of the rock is desired, only tensile failure to produce a crack between boreholes is desired. Thus, much lower pressures are required to be generated by the explosive reaction when presplitting rock as opposed to production blasting of rock. This is controlled by the quantity of explosive distributed in a borehole in relation to the total volume of the borehole. This relationship is known as the "decoupling ratio." The annulus of air between the explosive and borehole wall serves as a pressure drop mechanism. This mechanism allows for the explosive pressure to drop below the compressive strength of the surrounding rock. This assures that the surrounding rock is not overly fractured. However, the tensile strength of the rock is surpassed and it fails in tension along a common plane between the adjacent presplit boreholes. In short, the tensile stress must be maximized while the compressional stresses must be minimized. Then, optimal presplit cracks are formed between the adjacent presplit boreholes.

Since control of the distribution of the explosive is critical for successful presplit blasting, the way in which the explosive material is packaged and therefore delivered into the borehole becomes the crucial focus for presplit applications. There are currently some explosive packaging techniques for presplitting rock but they do not allow axial detonation (the optimum and desired type of detonation) while keeping the detonating cord and the explosive material physically separate. Part of the innovation of the present invention lies in the unique way in which the explosive material is contained within the explosive cartridge to allow it to be axially detonated by the detonating cord while keeping the explosive material and the detonating cord physically separate. This unique feature allows the explosive cartridge product of the present invention to be handled more effectively and efficiently in the borehole loading process. It also lends more control of the presplit load distribution through the use of nonexplosive spacer cartridges.

Other designs for presplitting rock include continuous link products that look somewhat like sausage "links" or "chubs." One manufacturer of these chubs is Slurry Explosive Corporation whose continuous link product is crimped with metal clips at 16 inch intervals. This practice confines the explosive material into individual "chubs" with the detonating cord running through the crimp and chub. Since detonating cord is susceptible to detonation from impact and pressure, the crimping of the detonating cord can present potential safety problems. With this chub product, there is no assurance that the detonating cord is in the center of each chub so that it is axially detonated. Furthermore, the detonating cord is in contact with the explosive material in the continuous link product which can also be hazardous. An accidental detonating cord ignition could detonate the entire length of explosive that it contacts. The fact that detonating cord is being routed through machinery in the manufacturing process can also present potential safety concerns. The production sequence must also allow for the insertion of the detonating cord into the assembly, complicating the manufacturing process. Furthermore, the diameter of the detonating cord can also vary with a given tolerance. The pressure exerted by the crimps on the detonating cord that is slightly oversized can disrupt the detonation signal during initiation of the continuous link product. The continuous link products have less than ideal performance in the field due to the fact that sometimes not all of the explosive material is disintegrated during the blasting, which may be due to the crimping and/or not being axially detonated. This can be a serious problem because it is unlawful to leave undetonated explosive material in the field and undetonated explosive material can be hard to find in the fractured rock.

Another manufacturer of the continuous link product tapes the detonating cord to the outside of the chubs to avoid the crimping of the product. One problem with this product s that there is no axial detonation of the explosive material. In addition, the situation still exists where a significant length of detonating cord contacts a significant quantity of explosive material. The detonating cord must also be threaded through machinery that winds the detonating cord around each individual chub. While this seems to be a safer process than the continuous link product of Slurry Explosive Corporation, the results of a premature detonating cord ignition would still be catastrophic.

The present invention has numerous advantages over the current continuous link products and cartridged dynamites. These advantages are realized in the manufacturing process, product reliability, product flexibility, and performance. The first advantage is realized in the manufacturing process. Since detonating cord is not integrated into the manufacturing process like the other products, the explosive cartridge product of the present invention makes manufacturing safer and more efficient. The integration of the detonating cord into the manufacturing process by these other manufacturers slows down and complicates the manufacturing process. Unlike some other products, the assembly process of the present invention is not complicated by inserting detonating cord into the center of the polyfilm package that holds the explosive material.

The manufacturing of the present invention only requires the filling of the explosive cartridge with a water gel or emulsion explosive material and inserting the end caps. With the present invention, the product and the detonating cord do not come together until the actual borehole loading procedure in the field. This allows for a safer and more productive manufacturing and shipping environment.

The continuous link products also present problems for applications where a reduced charge is desired. Presplitting in weak block formations may require reduced energy to prevent over fracturing of the strata. The continuous link products provide no easy way to accomplish this task when the minimum diameter is being utilized. Reduction of the charge weight requires the cutting of the continuous link product and then splicing sections of the continuous link product together with detonating cord. The detonating cord connecting the sections of linked product then becomes the spacer. The other method requires the slicing and removal of water gel explosive material from alternating chubs. These methods hinder the loading process, expose workers to contact with the explosive chemicals, create a disposal problem for the unused explosive material, and add unwanted costs. The explosive cartridges of the present invention overcomes these problems by allowing nonexplosive spacer cartridges to be inserted between the filled explosive cartridges to get a reduced charge in the borehole.

The "air decking" and suspended charge" methods that are utilized in larger diameter boreholes in surface mine applications also have several disadvantages as compared to the distributed charge of the present invention using nonexplosive spacer cartridges. Air decking is accomplished by introducing a single charge at the bottom of the borehole. This charge length is typically 10% of the height of the borehole. This charge is typically ANFO in dry borehole applications, but may be an emulsion blend or "wet bag" in wet borehole applications. This charge is typically primed with a cast or dynamite primer connected to a detonating cord downline or blasting cap. After the bottom charge is introduced, the top of the borehole is blocked off with an inflatable air bag, gas bag, wedge, suspended stemming bag, or other technique. This empty void is responsible for the "air deck" name that is given to this technique. Upon detonation the gases from the explosive migrate to the unloaded portion of the borehole and begin to exert pressure on the borehole walls. This pressure exerted along a common plane is responsible for the preshearing associated with this technique. This is obviously an inferior method of distributing the charge throughout the length of the borehole. A continuous charge of a smaller diameter is the most efficient for actual results. However, the expense of this product is often economically prohibitive for actual applications. The "suspended charge" method is somewhat of a compromise between a manufactured small diameter continuous product and "air decking" loading. The distributed charge of the present invention using nonexplosive spacer cartridges is ideal.

There are some patents related to explosive cartridges and coupling devices for explosive cartridges. U.S. Pat. Nos. 3,332,349 (Schwoyer, et al.), 3,349,705 (Wilson), 5,435,250 (Pollock), and 2,697,399 (McAdams) relate to explosive cartridges or couplers but there is no disclosure of detonating cord being strung axially through a detonation passageway in the explosive cartridges. For example, U.S. Pat. No. 2,697,399 (McAdams) discloses a wire line extending through an assembly of tubular charges for lowering this assembly into a hole used for oil well blasting (not for presplitting rock), but there is no axial detonation. Unlike the present invention, U.S. Pat. Nos. 3,276,370 (Foster), 3,276,371 (Newman et al.), 3,332,349 (Schwoyer et al.), and 4,294,171 (Ducharme) disclose couplings or coupling devices to couple the explosive cartridges together.

The present invention includes a small diameter explosive cartridge and a two-stage large diameter explosive cartridge apparatus for presplitting rock can be axially detonated by detonating cord through a central detonation passageway in the explosive cartridge while keeping the detonating cord and the explosive material in the explosive cartridge physically separate. The explosive cartridge includes an outer tube and an inner tube inside of the outer tube. The explosive cartridge includes two or more continuous webs extending radially between the outer surface of the inner tube and the inner surface of the outer tube. The radial webs preferably extend longitudinally along the inner tube and the outer tube. For the small diameter explosive cartridge, the space between the outer surface of the inner tube and the inner surface of the outer tube is filled with high explosive material such as water gel or emulsion explosive material. The inside of the inner tube forms a central detonation passageway axially through the small diameter explosive cartridge through which detonating cord can be strung to provide axial detonation and to provide effective detonation between each of the small diameter explosive cartridges when the small diameter explosive cartridges are assembled on a line of detonating cord in a borehole, while keeping the detonating cord and the emulsion explosive material in the small diameter explosive cartridge physically separate.

The two-stage large diameter explosive cartridge apparatus includes a large diameter explosive cartridge and a small diameter explosive cartridge. The construction of the large diameter explosive cartridge is similar to the small diameter explosive cartridge but of a larger scale so that the small diameter cartridge can slide into the central primer passageway of the large diameter explosive package. For the large diameter explosive cartridge, the space between the outer surface of the inner tube and the inner surface of the outer tube is filled with blasting agent material. The small diameter explosive cartridge then acts as a primer to initiate the large diameter explosive cartridge.

Various objects and advantages of the present invention will become apparent from the following detailed description when viewed in conjunction with the accompanying drawings, which set forth certain embodiments of the invention.

DETAILED DESCRIPTION OF THE PREFERRED EMBODIMENTS

The detailed embodiments of the present invention are disclosed herein. It should be understood, however, that the enclosed embodiments are merely exemplary of the invention, which may be embodied in various forms. Therefore, the details disclosed herein are not to be interpreted as limiting, but merely as a basis for teaching one skilled in the art how to make and/or use the invention.

There are two explosive packaging subsystems involved in the present invention which can be defined by the range of borehole diameter each is used in: (1) small diameter explosive cartridge and (2) large diameter explosive cartridge.

Small Diameter Explosive Cartridge

Figure 1:
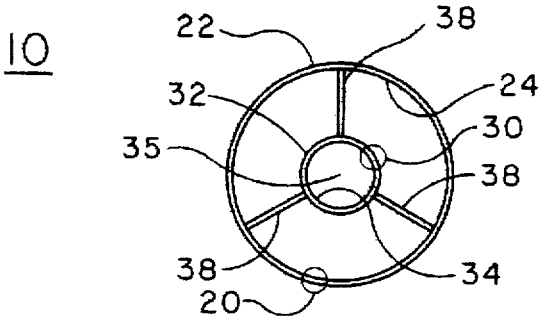
FIG. 1 is an end view of the small diameter explosive cartridge in accordance with the present invention.
Figure 2:
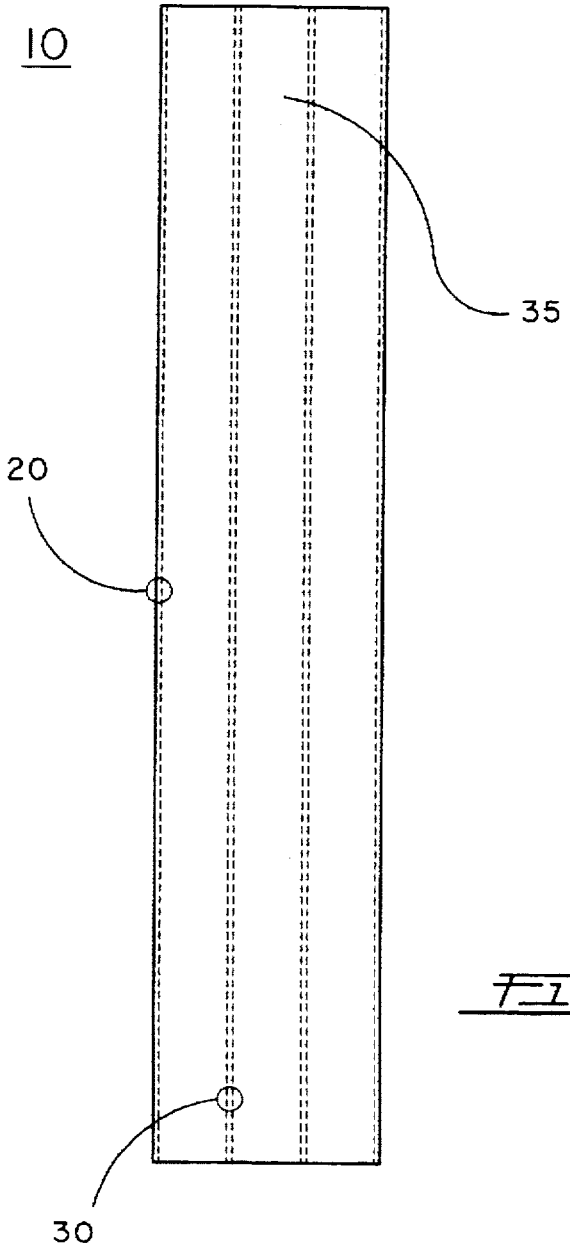
FIG. 2 is a side view of the small diameter explosive cartridge in accordance with the present invention.

The small diameter explosive cartridge (1–2 inch diameter) is a specially designed tubular explosive cartridge, factory loaded with a high explosive material and can be considered to be a one stage system (See FIGS. 1 and 2). The small diameter explosive cartridge is typically loaded into 3 to 5 inch diameter boreholes as a continuous charge length although blank cartridges can be used as spacers if so desired by the required charge distribution design.

The small diameter explosive cartridge 10 for presplitting rock can be axially detonated by detonating cord through a central detonation passageway 35 in the explosive cartridge 10 while keeping the detonating cord and the explosive material in the explosive cartridge 10 physically separate. The small diameter explosive cartridge 10 includes an outer tube 20 with an inner surface 24 and an outer surface 22. The small diameter explosive cartridge 10 also includes an inner tube 30 inside of the outer tube 20 with the inner tube 30 having an inner surface 34 and an outer surface 32. The small diameter explosive cartridge 10 includes two or more continuous webs 38 extending radially between the outer surface 32 of the inner tube 30 and the inner surface 24 of the outer tube 20. The radial webs 38 preferably extend longitudinally along the inner tube 30 and the outer tube 20. The small diameter explosive cartridge 10 may be formed of a two-part construction with the inner tube 30 and the radial webs 38 being a first part and the outer tube 20 being a second part. The first part would slide into the second part to form the small diameter explosive cartridge 10. The inner surface 24 of the outer tube 20 would preferable have holders secured thereto to form channels extending along the length of the outer tube 20, wherein the radial webs 38 fit into the channels so that the radial webs 38 and inner tube 30 cannot rotate axially inside the outer tube 20. The space between the outer surface 32 of the inner tube 30 and the inner surface 24 of the outer tube 20 is filled with high explosive material such as water gel or emulsion explosive material. The inside of the inner tube 30 forms a central detonation passageway 35 axially through the small diameter explosive cartridge 10 through which detonating cord can be strung to provide axial detonation and to provide effective detonation between each of the small diameter explosive cartridges 10 when the small diameter explosive cartridges 10 are assembled on a line of detonating cord in a borehole, while keeping the detonating cord and the emulsion explosive material in the small diameter explosive cartridge 10 physically separate.

A plastic tube for each unit is preferably manufactured from a continuous extrusion process. The diameters of the inner tube 30 and the outer tube 20 may vary according to the desired specifications of the final product. Typical dimensions of the small diameter explosive cartridge are: the diameter of the outer tube 20 is about 1.0 inches, the diameter of the inner tube 30 is about 0.2 inches (or large enough for detonating cord to be strung therethrough), with the wall thickness of the outer tube preferably being about 0.04 inches, the wall thickness of the inner tube 30 being about 0.02 inches, and the thickness of the webs 88 being about 0.04 inches. In a preferred embodiment, the webs 38 are equally spaced apart from each other and it is preferable to have three webs 38 that are 120° apart from each other. The length of the small diameter explosive cartridge may vary depending on the application but one preferred length is 36 inches long. The inner and outer tubes may also be made of suitable paper, cardboard or other suitable materials. The present invention is not limited to specific dimensions which can vary based on the application in the field and the manufacturing process.

Figure 3:
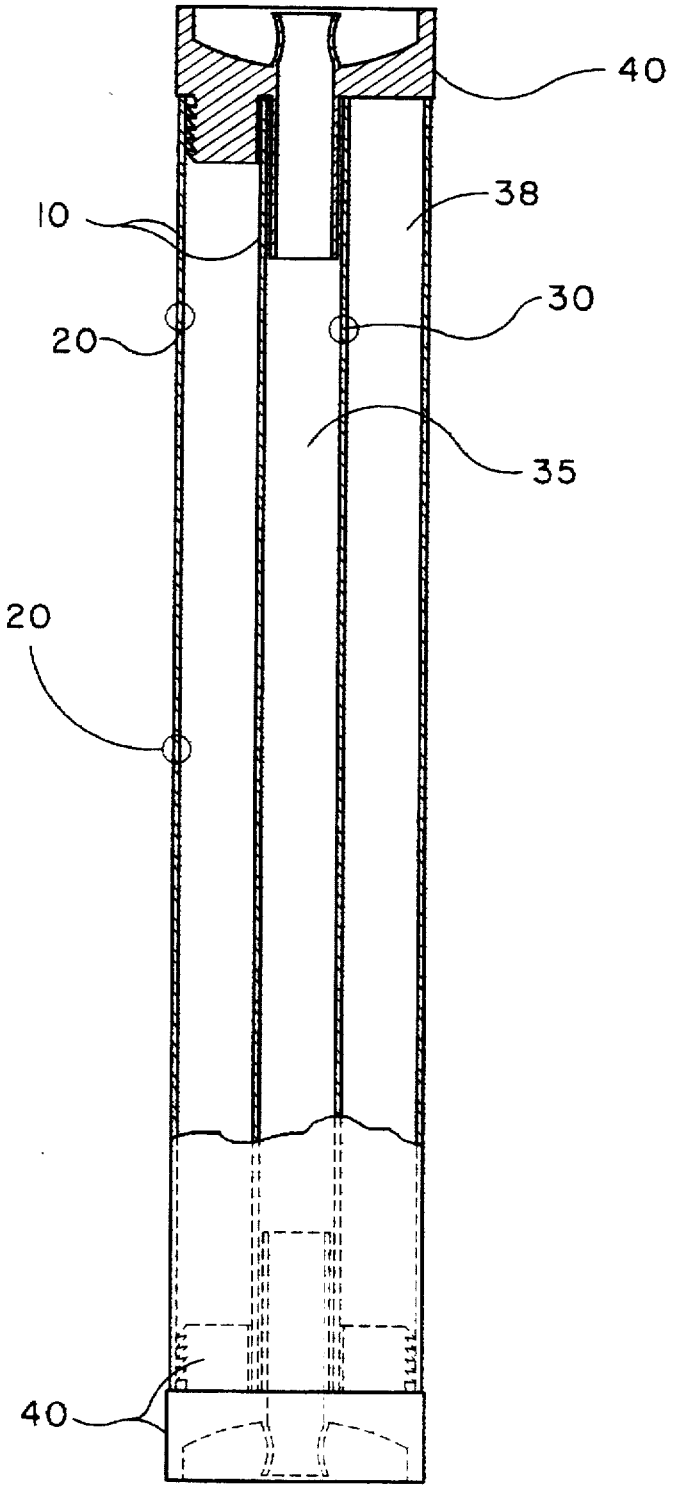
FIG. 3 is a side view of the small diameter explosive cartridge and end cap in accordance with the present invention.

The small diameter explosive cartridge 10 also includes end caps 40 having a hole therethrough to allow detonating cord to be strung through the hole in the end caps 40 from the detonation passageway 35. The end caps 40 for each explosive cartridge 10 are preferably manufactured from High Density Polyethylene Plastic (HDPE) formed from custom injection molds. The basic purpose of these caps is to contain the explosive material inside the tube so that it does not fall out either end. There also may be a cavity formed in end cap 40 to accommodate a blasting cap if so desired as an initiation option. The caps 40 may seat by a friction fit to the inside of the web walls of the small diameter explosive cartridge 10. (See FIG. 3)

In the manufacturing assembly, a stainless steel lance that is designed to fit inside each of the spaces of the small diameter explosive cartridge 10 created by the web walls 38 is used to inject the manufactured emulsion explosive material into the small diameter explosive cartridge 10. When the complete presplit explosive cartridge product is being manufactured, a four step process is followed. First, the empty small diameter explosive cartridge 10 is fitted onto the stainless steel lance. Secondly, one end cap 40 is inserted onto the opposite end of the small diameter explosive cartridge 10. An emulsion pump that is connected to the lance is activated to pump a preset amount of explosive material through the lance and into each small diameter explosive cartridge 10. As the explosive material fills the small diameter explosive cartridge 10, it is displaced off of the lance. The final step involves the insertion of a second end cap 40 onto the open end of the small diameter explosive cartridge 10. Once capped, the assembled unit is ready for packing, shipping and designed use in the field.

Large Diameter Explosive Cartridge

The large diameter explosive cartridge (3–6 inch diameter) is typically loaded in 6–9 inch diameter boreholes drilled on wider centers and is generally intended to be used in the "suspended charge" presplit loading technique. This is where the required borehole load is distributed in several "suspended charges" to produce the desired presplit effect. Cost constraints typically prohibit a continuous load in larger diameter boreholes thus this technique offers an economical method to obtain good presplit results by using cheaper blasting agents.

Figure 4:
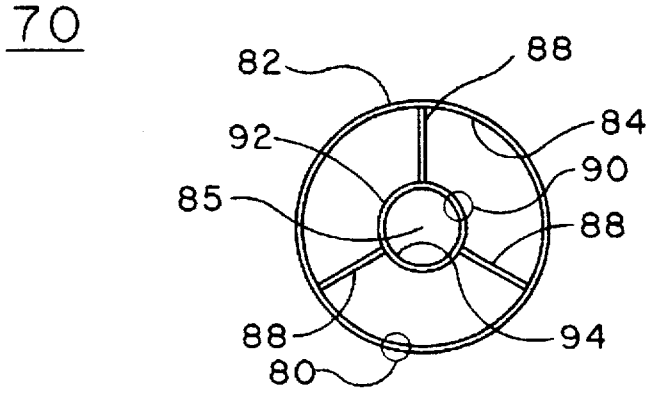
FIG. 4 is an end view of the large diameter explosive cartridge in accordance with the present invention.
Figure 5:
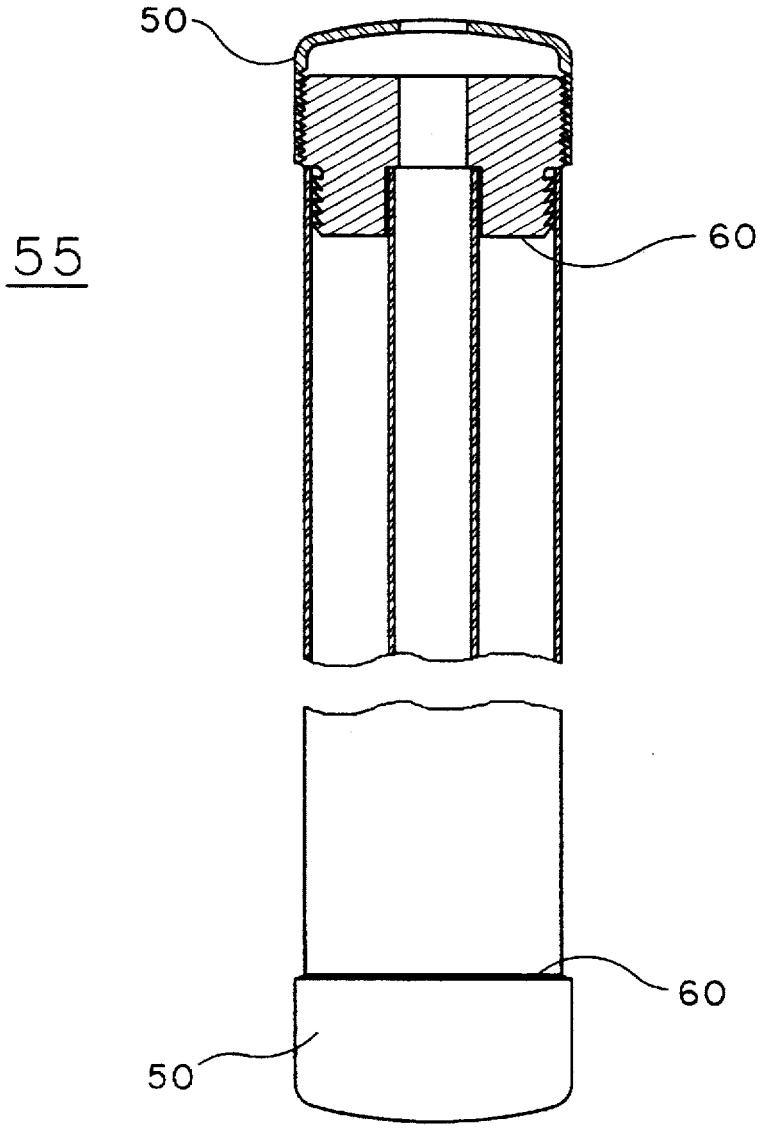
FIG. 5 is an side view of the end cap configuration of the large diameter explosive cartridge in accordance with the present invention.
Figure 6:
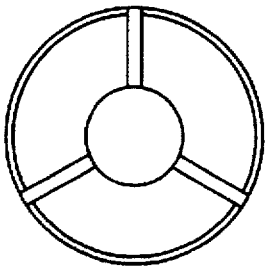
FIG. 6 is a plan view of the end cap configuration of the large diameter explosive cartridge in accordance with the present invention.

The large diameter explosive cartridge 70 is similar to the small diameter explosive cartridge 10. However, there are differences between them, including that the large diameter explosive cartridge 70 is of a larger scale, the large diameter explosive cartridge 70 is part of a two-stage system utilizing the small diameter explosive cartridge 10 that fits within the large diameter explosive cartridge 70 and acts as a primer of the large diameter explosive cartridge 70, the end cap configurations are different, and the large diameter explosive cartridge 70 typically is filled with a blasting agent rather than a high explosive material like the small diameter explosive cartridge 10 (See FIGS. 4, 5 and 6). The end cap configuration 55 is preferably a two-part construction with each half configured to mate together by threads. The lower half 60 seats by friction fit and serves the function of sealing the explosive material in the space between the inner tube 90 and outer tube 80 adjacent to the webs 88 of the large diameter explosive cartridge 70. This lower half 60 has female threads which allow the upper half 50 to be screwed into it with the male threads. The function of the upper half 50 is to contain the pre-assembled small diameter explosive cartridge 10 when it is chambered on site for priming purposes. The detonation passageway 35 of the small diameter explosive cartridge 10 is used as a detonation passageway for the initiation device, whether detonating cord or blasting cap. These end caps 55 are also preferably made of molded HDPE with the upper half 50 scalloped on the outside ring for hand gripping in the field assembly process. There may also be an eyelet molded on the outside base of each upper half 50 so that the large diameter explosive cartridge 70 can be tied off and suspended at the desired elevation in the borehole at actual loading.

Figure 7:
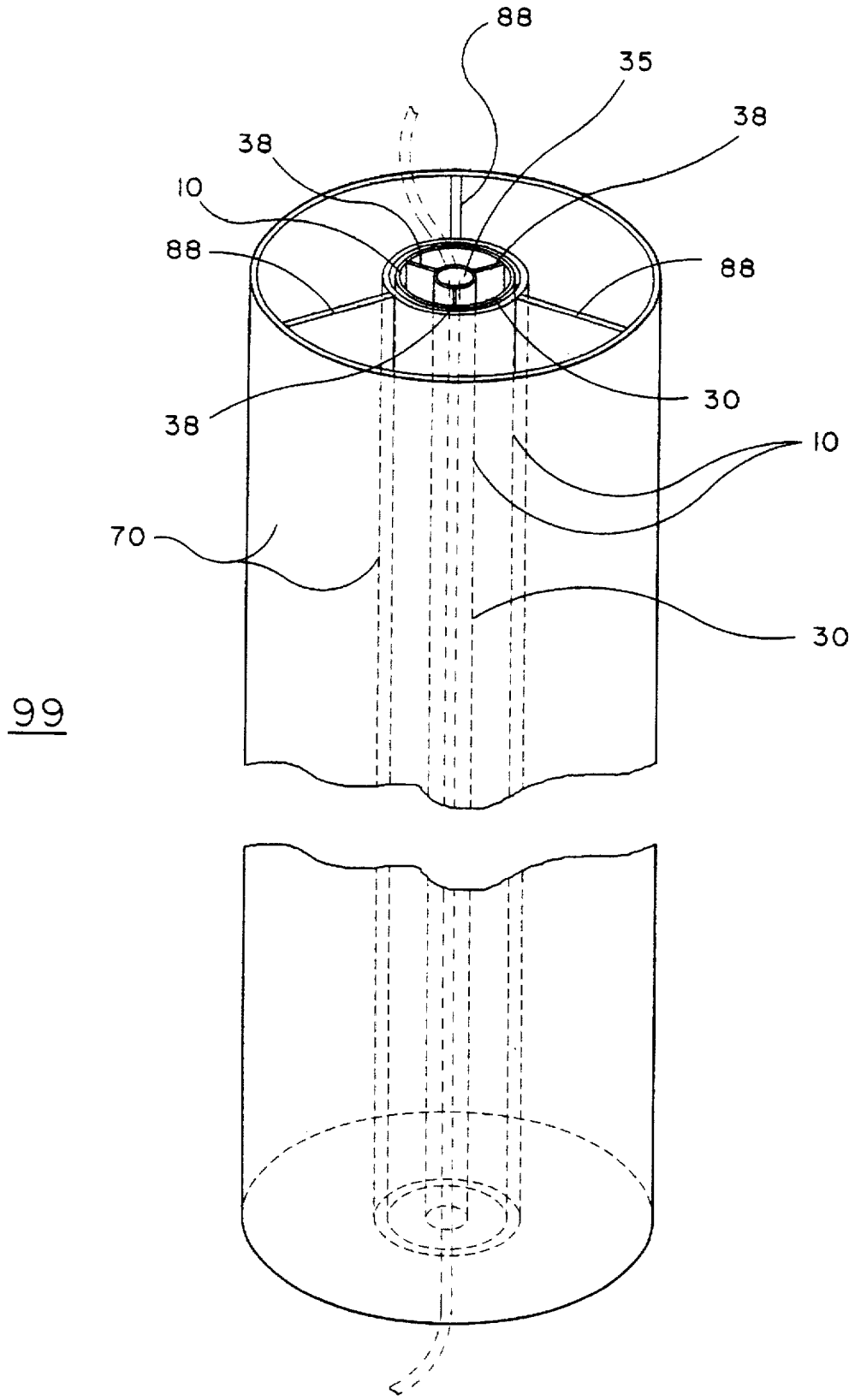
FIG. 7 is a perspective view of the two-stage large diameter explosive cartridge apparatus in accordance with the present invention.

In accordance with the present invention, as shown in FIG. 7, the two-stage large diameter explosive cartridge apparatus 99 for presplitting rock includes the small diameter explosive cartridge 10 as a "primer" explosive cartridge and the large diameter explosive cartridge 70 as a "blasting agent" explosive cartridge. The two-stage large diameter explosive cartridge apparatus 99 is axially detonated by detonating cord through a central detonation passageway 35 in the small diameter explosive cartridge 10 while keeping the detonating cord and the explosive material in the small diameter explosive cartridge 10 physically separate, and keeping the explosive material in the small diameter explosive cartridge 10 and the blasting agent in the large diameter explosive cartridge 70 physically separate. The detonating cord or blasting cap initiates the high explosive material in the small diameter explosive cartridge 10 that then acts as a primer to initiate the detonation of the blasting agent in the large diameter explosive cartridge 70.

The large diameter explosive cartridge 70 includes an outer tube 80 having an inner surface 84 and an outer surface 82. The large diameter explosive cartridge 70 also includes an inner tube 90 inside of the outer tube 80 with the inner tube 90 having an inner surface 94 and an outer surface 92. The large diameter explosive cartridge 70 includes two or more continuous webs 88 extending radially between the outer surface 92 of the inner tube 90 and the inner surface 84 of the outer tube 80. The webs 88 preferably extend longitudinally along the inner tube 90 and the outer tube 80. The large diameter explosive cartridge 70 may be formed of a two-part construction with the inner tube 90 and the webs 88 being a first part and the outer tube 80 being a second part. The first part would slide into the second part to form the large diameter explosive cartridge 70. The inner surface 84 of the outer tube 80 would preferable have holders secured thereto to form channels extending along the length of the outer tube 80, wherein the webs 88 fit into the channels so that the webs 88 and inner tube 90 cannot rotate axially inside the outer tube 80. The space between the outer surface 92 of the inner tube 90 and the inner surface 84 of the outer tube 80 is filled with a blasting agent. This space generally is factory loaded with a common blasting agent such as Ammonium Nitrate with Fuel Oil (ANFO), a blend of ANFO and emulsion explosive material, or loaded in the field directly from a bulk delivery truck. The inside of the inner tube 90 of the large diameter explosive cartridge 70 forms a central primer passageway 85 axially through the entire two-stage large diameter explosive cartridge apparatus 99 in which the small diameter explosive cartridge 10 is inserted, thereby keeping the emulsion explosive material and the blasting agent physically separate.

The diameters of the inner tube 90 and the outer tube 80 may vary according to the desired specifications of the final product. Typical dimensions of the large diameter explosive cartridge 70 are: the diameter of the outer tube 80 is about 4–6 inches, the diameter of the inner tube 90 is about 1.1 inches (large enough for the small diameter explosive cartridge to fit therein), with the wall thickness of the outer tube 80 preferably being about 0.04 inches, the wall thickness of the inner tube 90 being about 0.02 inches, and the thickness of the webs 88 being about 0.04 inches. In a preferred embodiment, the webs 88 are equally spaced apart from each other and it is preferable to have three webs 88 in the large diameter explosive cartridge 70 that are 120° apart from each other. The length of the large diameter explosive cartridge may vary depending on the application but one preferred length is 36 inches long. The inner and outer tubes may also be made of suitable paper, cardboard or other suitable materials. The present invention is not limited to specific dimensions which can vary based on the application in the field and the manufacturing process. The length of the small diameter explosive cartridge 10 is generally the same length as the large diameter explosive cartridge 70.

Once on site, the small diameter explosive cartridge 10 or the two-stage large diameter explosive cartridge apparatus 99 is loaded down the drill borehole designated for the presplitting function. In this borehole-loading process, detonating cord is threaded through the centrally located detonation passageway 35 in the inner tube 30, knotted and lowered to the bottom of the presplit borehole. Upon completion of this first step, the detonating cord is cut from its spool. Additional explosive cartridges are subsequently threaded onto the detonating cord and allowed to slide down the borehole on top of the previous explosive cartridge, much like threading beads on to a necklace. This process continues until the borehole is loaded to the desired height. The borehole is then stemmed to contain the explosive gases. The remaining tail of detonating cord from each borehole is then tied to another length of detonating cord trunkline. When the trunkline is initiated in the blast sequence, it detonates along its length at a rate of about 23,000 feet per second propagating the detonation of the downlines in the individual boreholes at the same rate. As the detonating cord downline detonates, it initiates the high explosive material contained in the small diameter explosive cartridges 10 which surround the detonation passageway 35. If the two-stage large diameter explosive cartridge apparatuses 99 are used, the detonation of the small diameter explosive cartridge 10 initiates the blasting agent in the large diameter explosive cartridges 70 since the large diameter explosive cartridge 70 is not blasting cap or detonating cord sensitive for detonation. The present invention's use of detonating cord axially through the detonation passageways of assembled explosive cartridges helps ensure the detonation of all of the cartridges that are assembled on the line of detonating cord.

The present invention also offers advantages in the stemming process. When coupled with a stemming plug, the present invention provides for a less damaging alternative for the detonating cord as it passes through the stemming zone. Since the plug slides axially down the detonating cord and rests on the last cartridge, no direct pressure exists on the detonating cord upline. Stemming material is simply introduced into the borehole and supported by the plug. This is in contrast to other methods of blocking the top of the borehole such as air bags, gas bags, wedges, and other methods that force the detonating cord to the side of the borehole and exert a pressure onto the detonating cord. Although this pressure can be slight, it may force the detonating cord against the rough edges of the borehole rock wall. In the right conditions, this could lead to disruption of the detonating cord. The position and condition of the detonating cord in the present invention is superior to other presplit products. This helps to improve performance and reliability and lessen the cost and safety liabilities that are associated with undetonated explosives.

The borehole loading process is also enhanced by the present invention. Once the detonating cord is lowered into the borehole with the first cartridge attached to the bottom of the detonating cord, the detonating cord at the top of the borehole is simply inserted through the detonating cord tunnel of each cartridge, and that cartridge allowed to slide into position. This is a quick process that results in lower labor costs associated with the loading. The present invention eliminates the need for splicing that exists in the continuous product. This eliminates the time and reliability factor associated with this process. With the exception of the knot that holds the first cartridge in place, this system does not require knots to be tied in the downline. The continuous link products require knots to be tied in detonating cord up-line that passes through the stemming zone to the top portion of the product. Since the present invention is slid into place, it does not require knots and the loading time and reliability factor associated with them. This can be immediately appreciated by the loading crew, especially in cold conditions. The present invention is also self supporting in the borehole. The continuous link product requires the support of the detonating cord up-line. If the borehole blocking device fails, the continuous link product and stemming can fall into the borehole, adding to the time, cost, and frustration factor associated with loading a presplit round. Since the present invention is self supporting, the product will not fall back into the borehole. No tension exists on the protruding detonating cord downline at the borehole collar and the trunkline can be connected at the desired time, adding to the convenience and safety.

The present invention allows the option of the large diameter explosive cartridges being pre-filled with blasting agent from the explosive distributor, or allowing the end user to load his own bulk blasting agent in the system. This allows the end user flexibility in the use of his labor force. A customer with surplus labor capacity may want to make use of this labor in filling the empty cartridges with his bulk blasting agent for future use. This can reduce costs and allow the end user to make product in advance, and store it as a blasting agent. Customers who do not possess surplus labor could purchase the units already pre-filled with blasting agent. This makes the product immediately available for transportation and use at the blast site. Another option available to the customer would be to fill the empty cartridges with blasting agent from a bulk truck at the blast site. With this method, only the exact number of units that are required for a specific application would be assembled. This eliminates the transportation of surplus units that were previously filled, from storage, to the blast site, and back to storage. This provides for a system that can be assembled for an as-needed only basis. The use of pre-filled or empty cartridges offers flexibility that can tailor costs to an operation's specific needs. This introduces cost efficient options to every customer, unlike the options available with current small diameter presplit products. The use of low cost blasting agents in the system also offers very low costs when compared to standard presplit products used in large diameter applications. Multiple air decks typically require the use of air or gas bags to separate the multiple charges with a column of air. The two-stage large diameter explosive cartridge apparatus 99 of the present invention does not require the use of air or gas bags since each charge is suspended by a detonating cord or rope. These bags can be quite expensive.

The large diameter explosive cartridges also offer advantages in product storage. As described above, preloaded cartridges are classified as a blasting agent. Since they are not primed until immediately before they are loaded into the borehole, the primary cartridges do not have to be stored in a Class "A" magazine. Pre-filled units can be stored in drop trailers, conserving valuable magazine space. If blast site assembly is desired the unloaded cartridges can be stored at any convenient location and do not adhere to any explosive storage criteria since no explosive material is present. The small diameter cartridges that are used as primers in the larger diameter products are Class "A" explosives and must be stored as such. However, a case of the small diameter cartridges will contain at least 50 units, having the priming potential for 50 large diameter cartridges. In a typical borehole loading scenario, one large diameter unit will occupy at least 20 linear feet of presplit borehole. As it can be seen, a few cases of small diameter cartridges for priming will account for a large amount of linear footage for presplit boreholes shot. This helps to minimize the quantity of Class "A" product that must be kept on hand and occupy limited magazine space.

This present invention simple to use. With technical support, the proper diameter explosive cartridge for a given diameter borehole can be chosen. The distribution of these cartridges can then be determined depending on specific factors such as rock type, borehole spacing, etc. After this has been calculated, loading this product is as simple as placing one cartridge for every specific length of borehole. For example one cartridge may be required for every 20 feet of borehole length. Loading a 60 foot deep presplit borehole would require three cartridges for each borehole. The cartridges would be placed at 60 feet, 40 feet, and 20 feet respectively. Each product could be suspended by its own strand of detonating cord, or by rope with a single detonating cord downline passing through the detonating cord tunnel of each individual cartridge. The single or multiple detonating cord downlines would each be tied into the surface trunkline for firing. If desired, blasting caps can be utilized to initiate each individual cartridge in addition to or entirely replacing detonating cord. Priming each individual large diameter explosive cartridge 70 is also be a very fast process. The product can quickly be primed at the borehole by unscrewing the end cap and inserting a small diameter explosive cartridge 70 as a primer into the center tunnel 85, and screwing the end cap back onto the cartridge. A Stem Tite stemming plug could also be utilized, as in the small diameter application, and simply slid into place to act as a support for the stemming material.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the abated claims.

What is claimed is:

1. An explosive cartridge for presplitting rock that can be axially detonated by detonating cord through a central detonation passageway in said explosive cartridge while keeping the detonating cord and the explosive material in said explosive cartridge physically separate, said explosive cartridge comprising:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with explosive material;

wherein the inside of said inner tube forms a central detonation passageway axially through said explosive cartridge through which detonating cord can be strung to provide axial detonation and to ensure detonation between explosive cartridges while keeping the detonating cord and said explosive material in said explosive cartridge physically separate.

2. The explosive cartridge of claim 1 further comprising a cap on each end of said cartridge, said caps having a hole therethrough to allow detonating cord to be strung through the hole from said detonation passageway.

3. The explosive cartridge of claim 1 wherein said webs are radial webs equally spaced apart from each other.

4. The explosive cartridge of claim 1 further comprising detonating cord strung through said detonation passageway.

5. The explosive cartridge of claim 2 wherein at least one of said end caps includes a cavity formed in the end cap to accommodate a blasting cap.

6. The explosive cartridge of claim 5 further including a blasting cap in said cavity of at least one of said end caps.

7. The explosive cartridge of claim 2 wherein said caps are seated to the inside of the surfaces of said outer tube by a friction fit.

8. A blasting assembly of explosive cartridges for presplitting rock that can be axially detonated by detonating cord through a central detonation passageway in said explosive cartridges while keeping the detonating cord and the explosive material in said explosive cartridges physically separate, and not requiring couplings between said explosive cartridges, said blasting assembly comprising:

(1) a length of detonating cord;

(2) a plurality of explosive cartridges threaded onto said detonating cord through the detonation passageway of each explosive cartridge, each of said explosive cartridges including:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube;

the space between said outer surface of said inner tube and said inner surface of said outer tube filled with explosive material; and a cap on each end of said cartridge, said caps having a hole therethrough to allow detonating cord to be strung through the hole from said detonating passageway;

wherein the inside of said inner tube forms a central detonation passageway axially through said explosive cartridge through which the detonating cord can be strung to provide axial detonation and to ensure detonation between explosive cartridges while keeping the detonating cord and said explosive material in said explosive cartridge physically separate.

9. The blasting assembly of explosive cartridges of claim 8 wherein at least one of said end caps includes a cavity formed in the end cap to accommodate a blasting cap.

10. The blasting assembly of explosive cartridges of claim 9 further including a blasting cap in said cavity of at least one of said end caps.

11. The blasting assembly of explosive cartridges of claim 8 further including one or more nonexplosive spacer cartridges threaded onto said detonating cord to distribute the charge of said explosive cartridges.

12. The blasting assembly of explosive cartridges of claim 8 further including a stemming plug having a hole therethrough to enable said stemming plug to slide down the detonating cord and rest on the upper explosive cartridge of said blasting assembly.

13. A two-stage large diameter explosive cartridge apparatus for presplitting rock that can be axially detonated by detonating cord through a central detonation passageway in said two-stage large diameter explosive cartridge apparatus while keeping the detonating cord and the explosive material in said two-stage large diameter explosive cartridge apparatus physically separate, and while keeping the explosive material and the blasting agent in said two-stage large diameter explosive cartridge apparatus physically separate, said two-stage explosive cartridge apparatus comprising:

(1) a small diameter explosive cartridge including:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with explosive material;

wherein the inside of said inner tube forms a central detonation passageway axially through said small diameter explosive cartridge through which detonating cord can be strung to provide axial detonation and to ensure detonation between two-stage large diameter explosive cartridge apparatuses while keeping the detonating cord and said explosive material in said small diameter explosive cartridge physically separate; and (2) a large diameter explosive cartridge including:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with a blasting agent;

wherein the inside of said inner tube forms a central primer passageway axially through said large diameter explosive cartridge into which said small diameter explosive cartridge is inserted, thereby keeping the explosive material and said blasting agent in said two-stage large diameter explosive cartridge apparatus physically separate.

14. The two-stage large diameter explosive cartridge apparatus of claim 13 further comprising an end cap configuration on each end of said explosive cartridges, said end cap configurations having a hole therethrough to allow detonating cord to be strung through the hole from said detonation passageway.

15. The two-stage large diameter explosive cartridge apparatus of claim 14 wherein said end cap configuration comprises a lower half and an upper half, said lower half and said upper half having a hole therethrough to allow detonating cord to be strung through the hole from said detonation passageway, said lower half fitting onto the end of said outer tube to retain the blasting agent material in said large diameter explosive cartridge, said upper half having threads to mate threads in the upper portion of said lower half so that the upper half can retain the small diameter explosive cartridge in said two-stage large diameter explosive cartridge apparatus.

16. The two-stage large diameter explosive cartridge apparatus of claim 15 wherein said upper half is scalloped to enable it to be gripped by hand.

17. The two-stage large diameter explosive cartridge apparatus of claim 15 further including an eyelet molded or connected to said upper half so that the two-stage large diameter explosive cartridge apparatus can be tied off or suspended at the desired elevation in the borehole.

18. The two-stage large diameter explosive cartridge apparatus of claim 13 wherein said webs are radial webs equally spaced apart from each other.

19. The two-stage large diameter explosive cartridge apparatus of claim 13 further comprising detonating cord strung through said detonation passageway.

20. The two-stage large diameter explosive cartridge apparatus of claim 14 wherein at least one of said end cap configurations includes a cavity formed in the end cap configuration to accommodate a blasting cap.

21. The two-stage large diameter explosive cartridge apparatus of claim 20 further including a blasting cap in said cavity of at least one of said end cap configurations.

22. A blasting assembly of two-stage large diameter explosive cartridge apparatuses for presplitting rock that can be axially detonated by detonating cord through a central detonation passageway in said two-stage large diameter explosive cartridge apparatuses while keeping the detonating cord and the explosive material in said two-stage large diameter explosive cartridge apparatuses physically separate, and while keeping the explosive material and the blasting agent in said two-stage large diameter explosive cartridge apparatuses physically separate, and not requiring couplings between said two-stage large diameter explosive cartridge apparatuses, said blasting assembly comprising:

(1) a length of detonating cord;

(2) a plurality of two-stage large diameter explosive cartridge apparatuses threaded onto said detonating cord through the detonation passageway of each two-stage large diameter explosive cartridge apparatus, each of said two-stage large diameter explosive cartridge apparatuses including:

(A) a small diameter explosive cartridge including:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with explosive material;

wherein the inside of said inner tube forms a central detonation passageway axially through said small diameter explosive cartridge through which detonating cord can be strung to provide axial detonation and to ensure detonation between the two-stage large diameter explosive cartridge apparatuses while keeping the detonating cord and said explosive material in said small diameter explosive cartridge physically separate; and (B) a large diameter explosive cartridge including:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with a blasting agent;

wherein the inside of said inner tube forms a central primer passageway axially through said large diameter explosive cartridge into which said small diameter explosive cartridge is inserted, thereby keeping the explosive material and the blasting agent in said two-stage large diameter explosive cartridge apparatus physically separate.

23. The blasting assembly of claim 22 further comprising an end cap configuration on each end of said two-stage large diameter explosive cartridge apparatuses, said end cap configurations having a hole therethrough to allow detonating cord to be strung through the hole from said detonation passageway.

24. The blasting assembly of claim 23 wherein said end cap configuration comprises a lower half and an upper half, said lower half and said upper half having a hole therethrough to allow detonating cord to be strung through the hole from said detonation passageway, said lower half fitting onto the end of said outer tube to retain the blasting agent material in said large diameter explosive cartridge, said upper half having threads to mate threads in the upper portion of said lower half so that the upper half can retain the small diameter explosive cartridge in said two-stage large diameter explosive cartridge apparatus.

25. The blasting assembly of claim 24 wherein said upper half is scalloped to enable it to be gripped by hand.

26. The blasting assembly of claim 24 further including an eyelet molded or connected to said upper half so that the two-stage large diameter explosive cartridge apparatus can be tied off or suspended at the desired elevation in the borehole.

27. The blasting assembly of claim 22 wherein said webs are radial webs equally spaced apart from each other.

28. The blasting assembly of claim 22 further comprising detonating cord strung through said detonation passageway.

29. The blasting assembly of claim 23 wherein at least one of said end cap configurations includes a cavity formed in the end cap configuration to accommodate a blasting cap.

30. The blasting assembly of claim 29 further including a blasting cap in said cavity of at least one of said end cap configurations.

31. The blasting assembly claim 22 further including one or more nonexplosive spacer cartridges threaded onto said detonating cord to distribute the charge of said two-stage large diameter explosive cartridge apparatuses.

32. A method of assembling explosive cartridges for presplitting rock that can be axially detonated by detonating cord through a central detonation passageway in said explosive cartridge while keeping the detonating cord and the explosive material in said explosive cartridge physically separate, said method comprising the following steps:

(1) providing an explosive cartridge comprising:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and wherein the inside of said inner tube forms a central detonation passageway axially through said explosive cartridge through which detonating cord can be strung to provide axial detonation and to ensure detonation between explosive cartridges while keeping the detonating cord and explosive material in said explosive cartridge physically separate;

(2) placing an end cap onto one end of said explosive cartridge;

(3) inserting a lance inside the spaces between said outer surface of said inner tube and said inner surface of said outer tube, said lance being inserted into the other end of said explosive cartridge from the end with the end cap;

(4) pumping explosive material through said lance and into the spaces between said outer surface of said inner tube and said inner surface of said outer tube, and adjacent to said webs, whereby said explosive cartridge is displaced off of said lance as the explosive material fills spaces of said explosive cartridge; and (5) placing an end cap onto said open end of said explosive cartridge.

33. A method of loading a borehole with explosive cartridges for presplitting rock that can be axially detonated by detonating cord through a central detonation passageway in said explosive cartridge while keeping the detonating cord and the explosive material in said explosive cartridge physically separate, said method comprising the following steps:

(1) providing explosive cartridges, each cartridge comprising:

an outer tube having an inner surface and an outer surface;

an inner tube inside of said outer tube, said inner tube having an inner surface and an outer surface;

two or more continuous webs extending radially between said outer surface of said inner tube and said inner surface of said outer tube, said radial webs extending longitudinally along said inner tube and said outer tube; and the space between said outer surface of said inner tube and said inner surface of said outer tube filled with explosive material;

wherein the inside of said inner tube forms a central detonation passageway axially through said explosive cartridge through which detonating cord can be strung to provide axial detonation and to ensure detonation between explosive cartridges while keeping the detonating cord and explosive material in said explosive cartridge physically separate;

(2) threading detonating cord through said detonation passageway of a first one of said explosive cartridges;

(3) form a knot in the end of the detonating cord and lower to the detonating cord and the first explosive cartridge to the bottom of a borehole;

(4) cut the other end of the detonating cord; and (5) thread additional explosive cartridges onto the detonating cord so that the explosive cartridges can slide down the borehole on top of the previous explosive cartridge until the borehole is loaded to the desired height.

34. The method of claim 33 further including the step of providing a stemming plug having a hole therethrough and sliding said stemming plug down the detonating cord onto the upper explosive cartridge in the borehole.

* * * * *

UNITED STATES PATENT AND TRADEMARK OFFICE
Certificate

Patent No. 5,798,477

Patented: August 25, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Richard W. Givens, Columbus, Ohio; Greg S. Williams, Alexandria, Ohio; and Brian G. Wingfield, Harrisburg, PA.

Signed and Sealed this Thirtieth Day of April 2002.

MICHAEL J. CARONE
*Supervisory Patent Examiner*
Art Unit 3641